US005259092A

United States Patent [19]

Lambe et al.

[11] Patent Number: 5,259,092

[45] Date of Patent: Nov. 9, 1993

[54] METHOD AND APPARATUS FOR CLEANING CARDING FLATS

[75] Inventors: Alphonsus J. Lambe, Fountain Inn; Gary F. Keener, Greenwood, both of S.C.

[73] Assignee: John D. Hollingsworth on Wheels, Inc., Greenville, S.C.

[21] Appl. No.: 960,613

[22] Filed: Oct. 13, 1992

[51] Int. Cl.[5] ..... D01B 15/76; A47L 5/14; A47L 5/38

[52] U.S. Cl. ..... 19/109; 15/312.1; 15/345; 19/107

[58] Field of Search ..... 19/102, 103, 108, 109, 19/110, 111, 107; 15/345, 346, 312.1

[56] References Cited

U.S. PATENT DOCUMENTS

| | | | |
|---|---|---|---|
| 2,823,423 | 2/1958 | Suzuki | 19/109 |
| 2,910,736 | 11/1959 | Clark | 19/109 |
| 3,150,415 | 9/1964 | Reiterer . | |
| 3,438,093 | 4/1969 | Rutz | 19/107 |
| 3,943,596 | 3/1976 | Wright et al. | 15/301 |
| 4,174,549 | 11/1979 | Michelson | 15/312.1 X |
| 4,227,285 | 10/1980 | Hamrick | 19/107 |
| 4,353,149 | 10/1982 | Demuth et al. | 19/107 |
| 4,380,842 | 4/1983 | Thomas | 15/312.1 X |
| 4,811,464 | 3/1989 | Giuliani | 19/107 |
| 4,831,691 | 5/1989 | Hollingsworth et al. | 19/98 |
| 4,905,500 | 3/1990 | Mason | 15/345 X |
| 4,985,966 | 1/1991 | Nitschke et al. | 19/107 |
| 4,996,746 | 3/1991 | Verzilli et al. | 19/111 |
| 5,008,972 | 4/1991 | Steinike | 15/345 X |
| 5,016,321 | 5/1991 | Hollingsworth et al. | 19/98 |
| 5,031,278 | 7/1991 | Demuth et al. | 19/98 |
| 5,111,551 | 5/1992 | Hollingsworth et al. | 19/150 |

*Primary Examiner*—Clifford D. Crowder
*Assistant Examiner*—John J. Calvert
*Attorney, Agent, or Firm*—Leatherwood Walker Todd & Mann

[57] ABSTRACT

Method and apparatus for the intermittent cleaning of carding flats by the use of pressurized air. A carriage having a plurality of nozzles is oscillated intermittently back and forth on a track adjacent to flats revolving about a carding cylinder of a carding machine. Pressurized air delivered from the nozzles on the flats blow trash and debris from the clothing of the flats downwardly into a vacuum plenum for disposal. A proximity sensor is provided for sensing a flat to initiate the cleaning cycle, wherein the carriage and nozzles are activated for cleaning a particular carding flat. After the cleaning cycle, delivery of pressurized air to the nozzles is ceased and is again activated upon the next predetermined cleaning of a carding flat.

22 Claims, 5 Drawing Sheets

METHOD AND APPARATUS FOR CLEANING CARDING FLATS

BACKGROUND OF THE INVENTION

This invention relates generally to a method and apparatus for cleaning elongated carding flats of a textile carding machine.

A typical textile carding machine converts fiber stock into a strand of fibers known as sliver. The carding machine receives fibers either in loose form or in the form of a picker lap, or, batt. The fibers are formed into a web by the carding machine, and this web is combed and cleaned of impurities.

A conventional carding machine typically has a carding cylinder, the surface of which is covered with small metallic wires or teeth, known as "clothing," which engage and transport the fiber web. The carding machine also typically includes a series of elongated bars known as "carding flats" which are interconnected at their ends by a chain. Each of the carding flats have on one side small wires, or, clothing. The flats extend across the width of the carding cylinder and are transported along a circuitous transport path, such that during an operative, or, interactive, portion of the transport path, the flats approach and contact from an opposite direction the web being carried by the carding cylinder. During this operative portion of the transport path, the clothing of the flats interacts with the web carried on the carding cylinder to remove debris and fine trash, or, "pepper trash" from the web. In normal operation, the clothing of the flats does not contact the carding cylinder clothing in operative portion of the transport path, but instead, the flats clothing is spaced just slightly from the carding cylinder clothing.

After time, trash and debris build up in the clothing of the flats and must be cleaned out in order for the flats to retain their effectiveness. Various types of devices are known for cleaning carding flats. Such conventional carding flat cleaning systems have often included combs and rotating brushes which mechanically engage the clothing of the flats to remove the fibers, trash, and debris therefrom. Various suction devices have also been used to clean the flats.

For example, U.S. Pat. No. 4,227,285, entitled "Textile Card Cleaning Apparatus," issued Oct. 14, 1980 to Hamrick, discloses a device wherein a plurality of suction hoods are provided on a carding machine above the carding cylinder for drawing trash and debris from the flats. U.S. Pat. No. 3,426,093, entitled, "Card Flat Cleaning System," issued on Apr. 15, 1969 to Rutz, discloses a card flat cleaning system which includes nozzles for blowing air the length of the carding flats, from one end of the carding flats to the other, and a low pressure chamber opposite the nozzles for receiving the trash and debris blown from the carding flats. U.S. Pat. No. 4,353,149, entitled, "Flat Cleaning Systems for a Card," issued Oct. 12, 1982 to Demuth, et al., also discloses a device where suction is used to clean carding flats.

U.S. Pat. No. 4,996,746, entitled, "Flat Cleaning Apparatus for a Card," issued Mar. 5, 1991 to Verzilli, et al., discloses a combination comb, brush, and suction device for cleaning carding flats. The comb, suction device, and brush are reciprocatable about the carding flats during cleaning.

Numerous problems exist with conventional carding flat cleaning systems. Often they are too complex and/or use an excessive amount of energy. Further, such mechanical devices require frequent adjustment to ensure that contact by the combs or brushes with the flat clothing is minimal or eliminated altogether. However, if the clearance between the teeth of the brushes and combs and the flats clothing is too great, then adequate cleaning of the flats will not be achieved. Moreover, brushes and combs tend to become clogged themselves, thereby requiring manual cleaning.

Although manual cleaning of carding flats by pressurized air is known, such a process labor intensive, time consuming and can potentially increase the amount of airborne trash and debris in and around the carding machine. With regard to mechanical cleaning systems such as those which use brushes and combs, the contact of such with the fine wire clothing of the flats tend to cause excessive wear of the flat clothing.

SUMMARY OF THE INVENTION

It is a principal object of this invention to provide a method and an apparatus for efficiently cleaning carding flats of a carding machine.

Another object of the present invention is to provide a device utilizing pressurized air to clean carding flats.

Another object of the present invention is to provide a device which cleans selected carding flats of a carding machine one at a time.

Another object of the present invention is to provide a flats cleaning device which may act intermittently to clean carding flats to minimize energy usage.

Another object of the present invention is to provide a flats cleaning device which can be readily adapted to a wide variety of carding machines.

Yet another object of the present invention is to provide a device for cleaning carding flats without the mechanical engagement with the carding flats clothing or debris therein.

Still another object of the present invention is to provide a flats cleaning device which requires minimal maintenance and adjustment.

Still another object of the present invention is to provide a method for cleaning carding flats which does not require mechanical contact with the carding flats clothing.

Generally, the present invention includes a flats cleaning device for cleaning debris from a series of elongated carding flats of a carding machine, the carding flats being carried about a circuitous transport path. The flats cleaning device includes a mounting structure associated with the carding machine, at least one nozzle associated with the mounting structure, with a nozzle having an inlet for receiving pressurized air and an outlet for directing the pressurized air towards the carding flat. Pressurized air delivery means are connected to the inlet of the nozzle for selectively delivering pressurized air to the nozzle inlet. Control means are connected to the pressurized air delivery means, with the control means selectively causing the pressurized air delivery means to deliver pressurized air to the nozzle inlet. Further, the flats cleaning device includes carding flat sensing means connected to the control means for sensing the position of a carding flat relative to the nozzle and for signaling the control means upon the carding flat being adjacent the outlet of the nozzle, such that the control means causes pressurized air to be delivered to the inlet of the nozzle. This allows pressurized air to be delivered from the outlet of the nozzle to the carding flat for cleaning debris therefrom.

More specifically, the flats cleaning device of the present invention may have a support structure associated with the carding machine, and a track connected to the support structure. A carriage is provided on the track for movement thereon with respect to the support structure, the mounting structure and the nozzle being carried by the carriage. Also, carriage moving means are connected to the carriage for selectively moving the carriage on the track. The carriage moving means is connected to and actuatable by the control means, such that upon the carding flat sensing means sensing a carding flat substantially adjacent to the nozzle, the carriage moving means moves the carriage adjacent a substantial portion of the length of the carding flat.

Additionally, the present invention includes a method of noncontact cleaning of debris from a plurality of elongated carding flats of a carding machine. In such a machine, the carding flats are carried about a circuitous transport path, a portion of the transport path being adjacent to a carding cylinder of the carding machine, and another portion of the transport path being spaced from the carding cylinder. Such carding flats are of the type having an interaction surface for interacting with the carding cylinder while on the portion of the transport path adjacent to the carding cylinder. The method includes transporting a carding flat along the transport path to an area for cleaning, such area being spaced away from the carding cylinder, and automatically positioning at least one nozzle adjacent the carding flat when the carding flat is in the area for cleaning. The method also includes directing pressurized air against the interaction surface of the carding flat and delivering pressurized air to the nozzle such that the pressurized air is delivered from the nozzle to the interaction surface of the carding flat for removal of debris therefrom.

Further, the method includes sensing the location of a carding flat to be cleaned among the plurality of carding flats. Upon sensing the location of the carding flat to be cleaned, delivery of the pressurized air to the nozzle is initiated, and delivery is made of the pressurized air to the nozzle for a predetermined period of time. Upon initiation of delivery of the pressurized air to the nozzle, the nozzle is oscillated along the length of the carding flat to be cleaned for a predetermined amount of time, and after that predetermined period of time pressurized air delivered to the nozzle is automatically shut off and oscillation of the nozzle is automatically stopped.

DESCRIPTION OF THE PREFERRED EMBODIMENT

Figure 1:
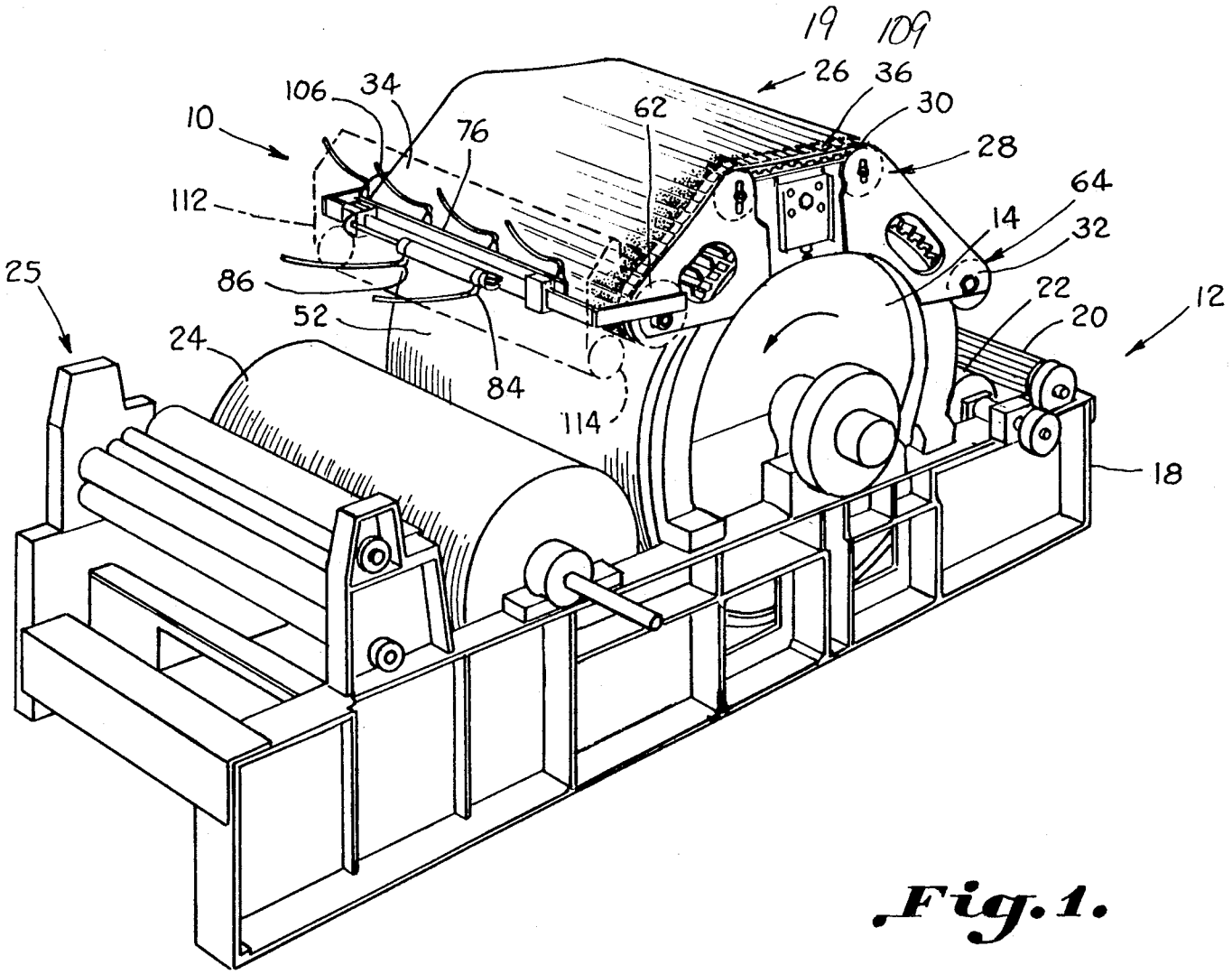
FIG. 1 is a perspective view of a carding machine embodying a flats cleaning device constructed in accordance with the present invention.

Referring to the drawings in detail, wherein like reference represent like elements or features throughout various views, the flats cleaning device of the present ion is designated generally in the figures by character 10.

Referring to the figures, FIG. 1 illustrates a carding machine, generally 12, having a carding cylinder 14. While flats cleaning device 10 is illustrated with a carding machine 12 having one carding cylinder 14, it is to be understood that flats cleaning device 10 can be used on carding machines having two or more carding cylinders.

Carding machine 12 includes a frame, generally 18, which supports carding cylinder 14 for rotation therein, and also supports feed roll 20, licker-in roll 22, and doffer roll for rotation with respect to frame 18. Transfer/crush roll set, generally 25, outputs the web from carding machine 12. Briefly, the fibers from a batt (not shown) are fed by feed roll 20 and to licker-in roll 22. Licker-in roll 22 assists in the transfer of the fiber mass to the carding cylinder 14 which ultimately delivers the fiber mass in the form of a web (not shown) to doffer roll 24. The fiber web is taken from carding cylinder 14 by the doffer roll 24 and thereafter condensed into sliver (not shown). The sliver is then subsequently processed for use in other textile operations.

A more complete understanding of the operation of carding machine 12 can be understood from U.S. Pat. No. 4,831,691, issued May 23, 1989; U.S. Pat. No. 5,016,321, issued May 21 1991; and U.S. Pat. No. 5,111,551, issued May 12, 1992, all being issued to Hollingsworth, et al., and all being incorporated herein by reference thereto and forming a part of this application.

Carding flats, also known as revolving flats, generally 26, are indicated in FIG. 1. Carding flats 26 are transported about a circuitous transport path, or, "revolve" about an upper portion of carding cylinder 14. Carding flat transport system, generally 28 transports carding flats 26 through the transport path and includes a toothed belt 30 which engages with toothed pulleys 32. Toothed pulleys 32 and a toothed belts 30 is provided on each side of the carding machine 12, such that each end 34, 36 of each carding flat 26 is received in a respective belt 30. Tensioning toothed pulleys 33 are provided for ensuring belts 30 are maintained tight. Opposite the toothed side 40 of belts 30 is a plurality of carding flat recesses 42.

Flats 26 are of a T-shaped cross-section and are slightly longer than the width of carding cylinder 14. The back portion of a carding flat 26 includes a rail 44, which forms one leg of the T-shaped cross-section, and runs substantially the length of a carding flat 26. However, rail 44 terminates slightly prior to each end 34, 36 in a projection 48 which is of less height than rail 44. Projections 48 ar received in and engaged by carding flat recesses 42 of belts 30 such that an individual carding flat 26 is substantially fixed with respect to belts 30. Accordingly, belts 30 transport all the carding flats 26 through such engagement of projections 48 of the individual flats 26 and carding flat belt recesses 42.

Each carding flat 26 includes fine wire flats clothing 50 which is attached to the carding flat opposite the side of the carding flat having rail 44. During the portion of the transport path of the carding flats wherein the flats clothing is adjacent the clothing 52 of carding cylinder 14, known as the interactive, or operative, portion 53 of the transport path, the upper surfaces 54 of the ends 34, 36 of the flats ride on a wear strip (not shown) which is positioned on the flexible bend 60 of carding machine 12. The wear strip extends the length of flexible bend 60 and is preferably constructed of glass filled nylon, known as Nylatron, although any other plastic or metal material offering a low coefficient of friction could be used. The wear strip is curved at carding flat reversal points 62, 64, where the carding flats reverse direction in the transport path, and are configured to retain the flats within belts 30 as the flats reverse direction are reversible points 62, 64. A wear strip is provided on each flexible bend 60, one of which being provided on both sides of the machine for engaging both ends 34, 36 of the carding flats.

Figure 2:
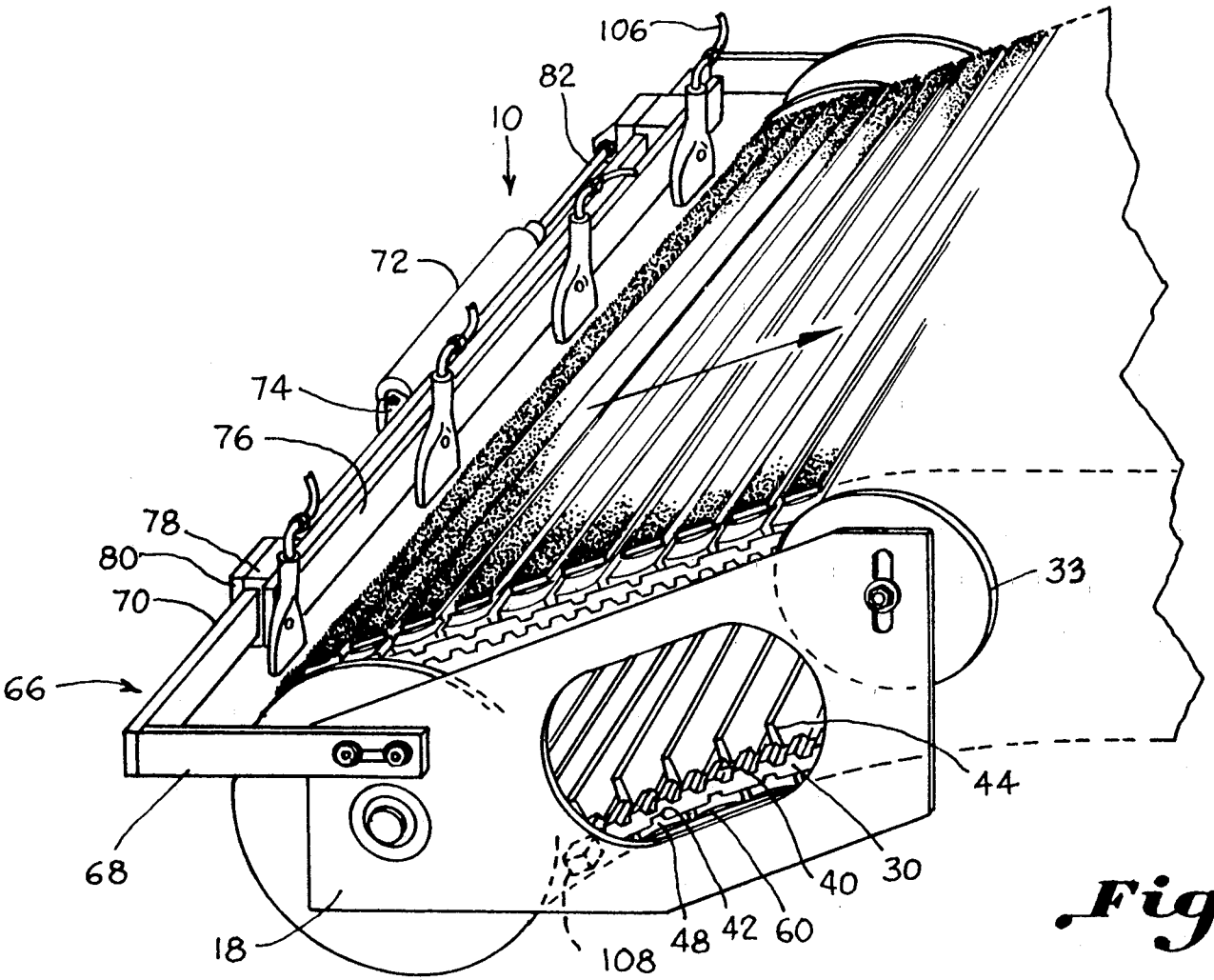
FIG. 2 is a perspective view of a flats cleaning device constructed in accordance with the present invention, without a vacuum plenum being shown.
Figure 4:
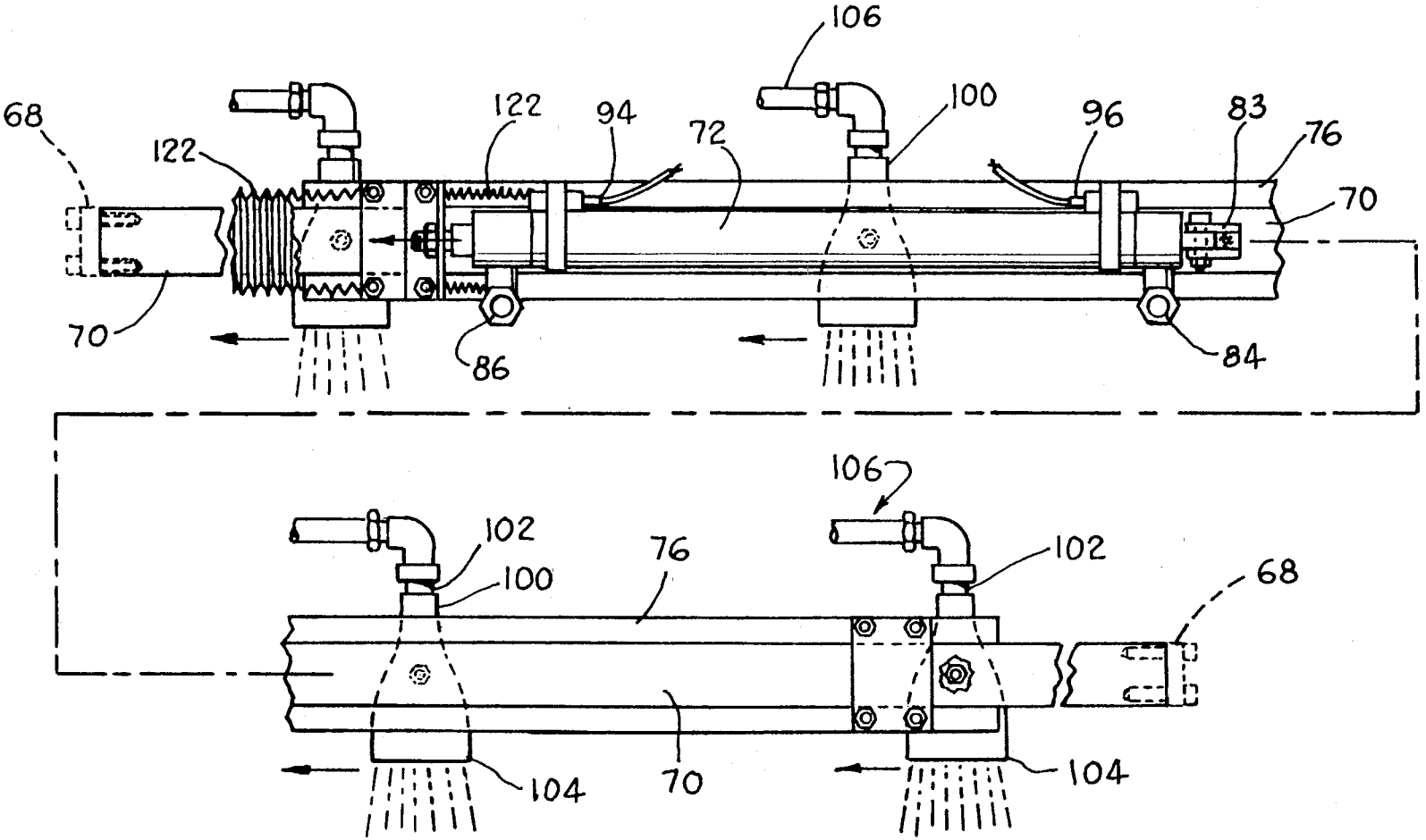
FIG. 4 is a front elevational view of a flats cleaning device constructed in accordance with the present invention.

Turning more specifically to flats cleaning device 10, FIGS. 2 and 4 show a mounting or support structure, generally 66, which attaches flats cleaning device 10 to frame 18 of carding machine 12. The support structure 66 includes brackets 68 connected to frame 14 by conventional fasteners. Brackets 68 would vary in configuration depending on the type of carding machine on which flats cleaning device 10 is installed. Attached to brackets 68 is a carriage rail or track 70 which extends the width of the card machine. While the figures indicate track 70 including a rail of rectangular cross-section, it is to be understood that any number of rail or track configurations could be used, including elongated rods instead of the rail, or track means which would allow for other than simple rectilinear movement of a carriage thereon. For example, track means could be provided which would cause a carriage to experience up and down motion, curvilinear motion, a circular motion, etc. if such was desired. Attached to rail 70 is a pneumatic piston/cylinder unit 72. Cylinder 72 is connected to track 70 by brackets 74, which are in turn connected to track 70 by conventional fasteners.

Carried on track 70 for sliding movement is carriage 76. Carriage 76 includes track receiving openings 78 through which track 70 is inserted. Track receiving openings 78 include glass-filled nylon bushings 80 or the like which provide for low friction transport of carriage 76 on track 70. Piston rod 82 of cylinder 72 is connected to carriage 76 by a clevis 83 or other conventional fastening means such that upon actuation of piston/cylinder unit 72, movement of the piston (not shown) in cylinder 72 causes rod 82 to move in and out of cylinder 72, and accordingly, causes carriage 76 to move substantially rectilinearly back and forth on track 70.

Cylinder 74 is preferably pneumatically operated, although a hydraulic cylinder, or any other type of fluid actuated cylinder or linear moving device, such as an electric motor with a rack and pinion gear combination, could be used to move carriage 76 back and forth along rail 70. Cylinder 72 is a double-action cylinder and includes two combination air inlet/outlets 84, 86 connected by hoses, generally 88, to a pressurized air or fluid delivery means, generally 90. Fluid delivery means 90 preferably includes a four-way valve 92 which directs pressurized air to either of inlet/outlets 84, 86 upon command of control means, which includes a programmed logic controller ("PLC") 93, to which four-way valve 92 is connected.

Cylinder 72 also includes carriage sensing means, generally 73, having first and second magnetic sensors 94, 96 connected adjacent opposite ends of cylinder 72 for sensing the position of the piston within cylinder 72. Sensors 94, 96 are connected to the PLC and act to signal the PLC upon sensing of the piston being in a predetermined position. For example, when magnetic sensor 96 senses the piston moving to a predetermined position approaching it, sensor 96 will signal the PLC 93, and the PLC will signal the four-way valve 92 to reverse the flow of pressurized air into cylinder 72 by directing air into inlet/outlet 86, or, depending on predetermined programming of the PLC, may activate a timer internal in the PLC for causing the piston to stop for a predetermined period of time set by the timer, before the piston is forced to return in the opposite direction within cylinder 72. It is to be understood that a timer external to PLC 93 could be used instead of the internal timer.

As shown in FIGS. 2 and 4, a plurality of nozzles 100 are attached to carriage 72 by conventional fastening means. Nozzles 100 each have an inlet 102 and an outlet 104, the outlet 104 having a plurality of small openings for delivering of a plurality of high pressure streams of air. Nozzles 100 can be of the type manufactured by Spray Systems Company, Model No. 727, identified as a Windjet®. Hoses, generally 106 are connected to nozzles 100 for delivering pressurized air thereto. Hoses 106 lead to a manifold 107 which is connected to a solenoid valve 109. The solenoid valve is of conventional design and is connected to a source of pressurized air, generally 111. Solenoid valve 109 controls delivery of pressurized air to nozzles 100 and is itself connected to the PLC for receiving actuation instructions therefrom.

Generally, the solenoid valve 109 actuating nozzles 100 will be activated at substantially the same time that four-way valve 92 is activated to move carriage 76 via cylinder 72.

A proximity sensor 108 is connected to carding frame 18 and senses when a reference flat approaches. The reference flat will be several flats upstream of a flat approaching a position adjacent nozzles 100 of flats cleaning device 10. Proximity sensor 108 senses the approach of the reference flat.

Flats cleaning device 10 also includes a shroud 110 adjacent to carriage 76 and track 70. Adjacent to shroud 110 is a vacuum housing, or, plenum 112 which is connected to and in communication with shroud 110. Vacuum plenum 112 could be of a variety of configurations, depending of the particular carding machine on which it is to be installed, and includes an exhaust opening 114 which is connected to a source of vacuum. Vacuum plenum 112 captures the trash and debris blown from the carding flats by nozzles 100 during the flats cleaning cycle of flats cleaning device 10.

Figure 3:
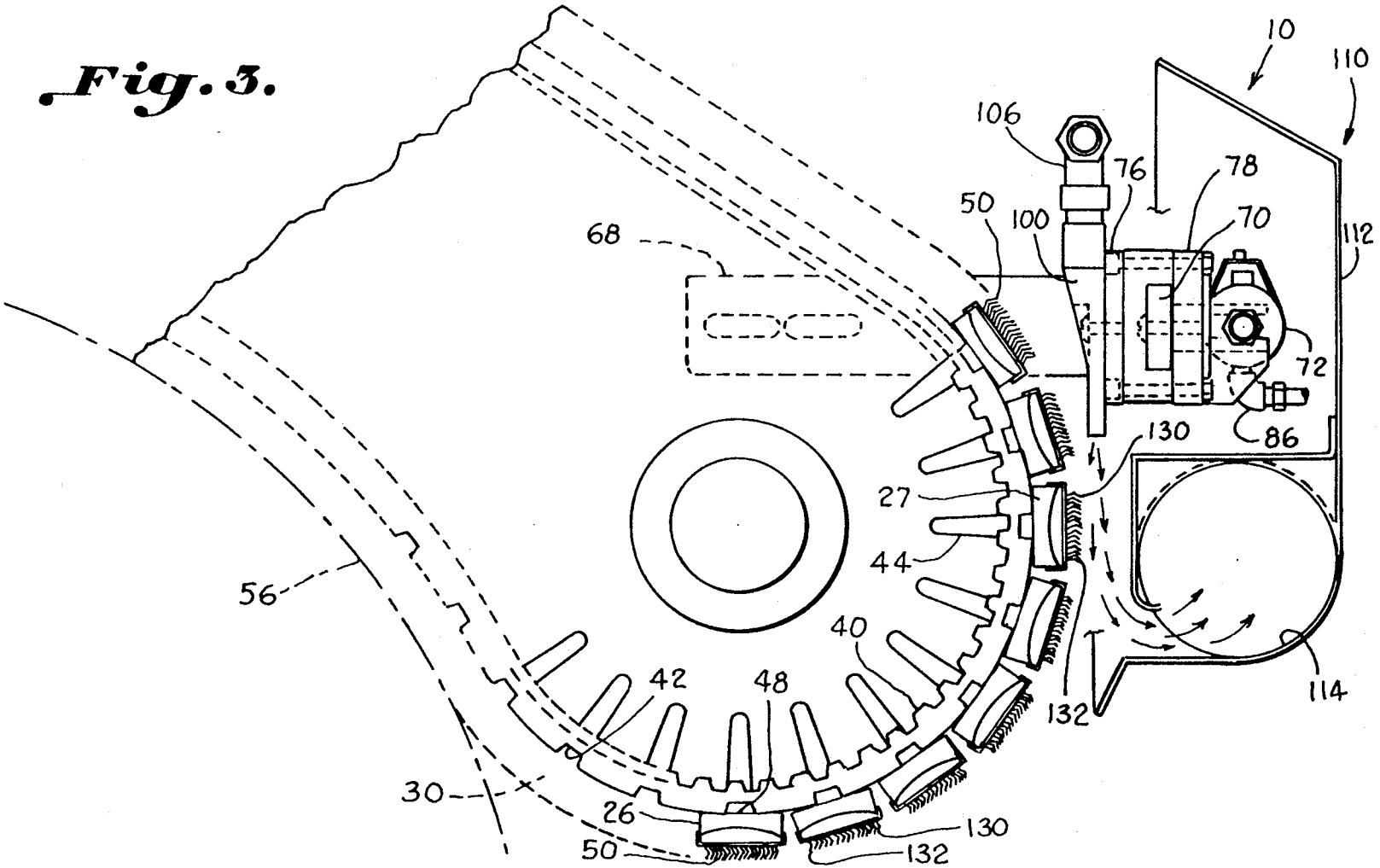
FIG. 3 is a side elevational view of a flats cleaning device constructed in accordance with the present invention.

In operation, the flats 26 are transported on belts 30 about the upper portion of carding cylinder 14. As the flats approach reversal point 62, proximity sensor 108 senses the location of a reference flat, which is spaced a predetermined number, of flats upstream of the flat to be cleaned as such approaches nozzles 100. Upon sensing of the reference flat, the proximity sensor signals the PLC, which activates four-way valve 92 and solenoid valve 109, such that pressurized air is delivered to cylinder 72 and nozzles 100 substantially simultaneously. Actuation of four-way valve 92 causes pressurized air to be delivered into inlet/outlet 84 which advances rod 82 outwardly from cylinder 72, which in turn forces carriage 76 to move towards the left, as shown in FIG. 1. The movement of carriage 76 along track 70 and the pressurized air delivered from nozzles 100 causes the upper longitudinal half, or the "toe" area 130, as shown in FIG. 3, of the flat to be cleaned as carriage 76 is advanced. Nozzles 100 are positioned such they direct pressurized air to the flat being cleaned in substantially a direction opposite to the direction in which flat is travelling. Also, nozzles 100 direct the pressurized air downwardly, substantially tangentially to, or, at a slight angle with respect to, the surface of the flats clothing being cleaned. In other words, and as shown in FIG. 3, the air blown by nozzles 100 blows through the clothing 50 of flats 26 in a direction substantially perpendicularly to the individual fine wires of the flats clothing 50. It is also to be noted that a flat 26 being cleaned is positioned such that it is substantially turned on its side when it is cleaned, as indicated by the particular flat 27 being cleaned in FIG. 3. This arrangement causes trash, debris, and even "microdust", which is not normally cleaned by traditional mechanical brush and comb systems, to be blown downwardly towards vacuum plenum 112 and sucked away through exhaust opening 114 thereof. Once carriage 76 reaches the end of track 70, after cleaning the toe area of the carding flat, magnetic sensor 96 senses the approach of the piston in cylinder 72 and signals the PLC 93. At this point, the timer causes a delay to occur, and after such delay, the PLC actuates four-way valve 92 such that pressurized air is delivered into inlet/outlet 86 to cause the piston to move in the opposite direction. This accordingly causes carriage 76 to travel substantially rectilinearly in a reversed direction on track 70 to clean the lower longitudinal half, or, "heel" area 132, as shown in FIG. 3, of the flat being cleaned. The delay in reversing the carriage is necessary to insure the full width of the flat being cleaned is adequately subjected to the pressurized air of nozzles 100.

On the reverse stroke of the piston during a typical cleaning cycle, magnetic sensor 94 senses the piston approaching and signals the PLC accordingly, such that delivery of air to nozzles 100 stops altogether upon sensing of the piston by magnetic sensor 94. This ends the cleaning cycle of the flats cleaning device, and the cleaning cycle is not initiated again until the proximity sensor 108 senses another flat rotating in a position to be cleaned by nozzles 100. Because of the slow movement of the flats, the shutting off of air to the flat cleaning device in between the cleaning of successive flats greatly reduces the usage of pressurized air, thereby reducing energy and equipment cost. Further, the intermittent usage of the pressurized air to clean the flats allows for a smaller vacuum plenum and vacuum system to be used because the amount of trash and debris entering the vacuum system is moderated by the intermittent operation of flats cleaning device 10. Without such intermittent and paced cleaning of the flats, the likelihood of large clumps of trash and debris entering and clogging the vacuum system would be increased.

However, depending on the types of fibers being cleaned or on other desired operational results, the oscillation of carriage 76 could be varied as desired. For example, carriage 76 may be instructed to make only one pass along a flat 27 being cleaned, and not to perform a reverse stroke along flat 27, if one pass of carriage 76 would be sufficient to clean the flat. Also, carriage 76 could be set up such that it oscillated continuously, instead of stopping after completion of a cleaning cycle.

Figure 5:
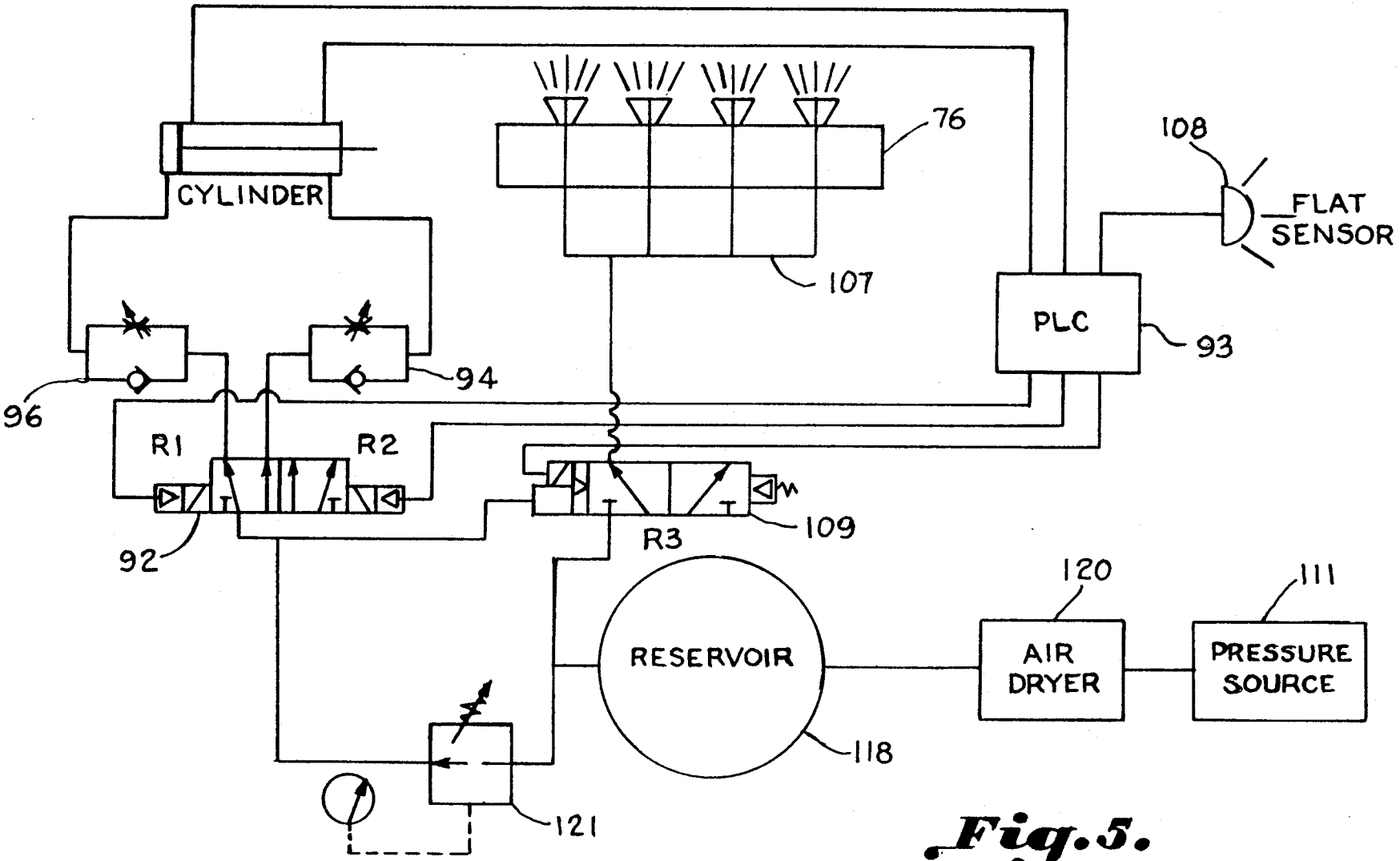
FIG. 5 is a schematic representation of a flats cleaning device constructed in accordance with the present invention.

FIG. 5 illustrates the schematic representation of flats cleaning device 10 and includes a pressurized air reservoir 118 and an air dryer 120 connected to one another, and to cylinder 72 and nozzles 100. A pressure regulator 121 for regulating air pressure ultimately delivered to cylinder 72 and nozzles 100 is connected to reservoir 118, four way valve 92, and solenoid valve 109. Reservoir 118 and air dryer 120 are of conventional design. Preferably, air pressure at approximately 80 pounds per square inch (PSI), or, 263 kPa ($N/m^2$), is provided for operating flats cleaning device 10, but various other air pressures and/or fluid pressures could be used.

In practicing the method of the present invention, it can be seen that a carding flat to be cleaned is transported by belts 30 to a position adjacent to nozzles 100, such position being determined by proximity sensor 108, based upon a predetermined time and distance between the flat to be cleaned and a reference flat sensed by proximity sensor 108. Upon sensing of the reference flat, delivery of pressurized air to nozzles 100 is initiated as carriage 76 oscillates back and forth on track 70 during a cleaning cycle, after which time pressurized air delivery to nozzles 100 and oscillation of carriage 76 is automatically stopped, upon sensing by a magnetic sensor of the piston in cylinder 72.

It is also to be noted that the carding flats do not necessarily have to be cleaned after each pass of the flats through the interaction area of the transport path. Flats cleaning device 10 can be constructed such that a particular flat is cleaned after a specific predetermined number of revolutions about the transport path.

To improve the reliability of flats cleaning device 10, enclosures or boots 122 may be provided on piston rod 82 and on track 70, to seal rod 82 and track 70 from outside air, and accordingly, from dirt, debris and trash which could accumulate on rod 82 and track 70 and cause a reduction in the efficiency of flats cleaning device 10.

While a preferred embodiment of the invention has been described using specific terms, such description is for present illustrative purposes only, and it is to be understood that changes and variations to such embodiment, including, but not limited to, the substitution of equivalent features or parts, and the reversal of various features thereof, may be practiced by those of ordinary skill in the art without departing from the spirit or scope of the following claims.

What is claimed is:

1. An apparatus for cleaning debris from a series of elongated carding flats of a carding machine, the carding flats being substantially continuously carried about a circuitous transport path, comprising:

a mounting structure associated with the carding machine;

at least one nozzle associated with said mounting structure, said nozzle having an inlet for receiving pressurized air and an outlet for directing the pressurized air towards at least one carding flat;

pressurized air delivery means connected to said inlet of said nozzle for selectively delivering pressurized air to said inlet of said at least one nozzle;

control means connected to said pressurized air delivery means for selectively causing said pressurized air delivery means to deliver pressurized air to said inlet of said at least one nozzle; and carding flat sensing means connected to said control means for sensing the position of a carding flat relative to said at least one nozzle and for signaling said control means upon the carding flat being adjacent said outlet of nozzle such that said control means causes said pressurized air to be delivered to said inlet of said nozzle, thereby allowing pressurized air to be delivered from said outlet of said nozzle to the carding flat for cleaning debris from the carding flat, and wherein said control means causes said pressurized air delivery means to cease delivery of pressurized air to said inlet of said nozzle upon the carding flat no longer being positioned adjacent said outlet of said nozzle.

2. An apparatus as defined in claim 1, further comprising:

a support structure associated with said carding machine;

a track connected to said support structure;

a carriage carried on said track for movement on said track with respect to said support structure, said mounting structure and said at least one nozzle being carried by said carriage; and carriage moving means connected to said carriage for selectively moving said carriage on said track; said carriage moving means being connected to and actuatable by said control means, such that upon said carding flat sensing means sensing a carding flat substantially adjacent to said nozzle, said carriage moving means moves said carriage adjacent a substantial portion of the length of the carding flat.

3. An apparatus as defined in claim 2, wherein said carriage moving means is a pneumatic cylinder which is connected to said support structure, said carriage, and said pressurized air delivery means; said control means causing pressurized air to be delivered to said pneumatic cylinder for actuation thereof.

4. An apparatus as defined in claim 2, further comprising carriage sensing means connected to said control means for sensing the position of said carriage on said track, said carriage sensing means signaling said control means for allowing said pneumatic cylinder unit to move said carriage along said track such that pressurized air may be directed from said outlet of said at least one nozzle to a substantial portion of the length of a carding flat.

5. An apparatus as defined in claim 2, wherein said track is at least one longitudinally extending rail.

6. An apparatus as defined in claim 1, further comprising vacuum means spaced from said at least one nozzle for receiving and transporting away from the carding machine debris removed from a carding flat by said at least one nozzle.

7. An apparatus as defined in claim 1, wherein said at least one nozzle is configured for directing pressurized air from said outlet thereof in a direction substantially opposite to the direction of travel of the carding flats about said transport path.

8. An apparatus for cleaning debris from a series of elongated carding flats of a carding machine, the carding flats being substantially continuously transported about a circuitous transport path, comprising:

a mounting structure associated with the carding machine;

at least one nozzle associated with said mounting structure, said nozzle having an inlet for receiving pressurized air and an outlet for directing the pressurized air towards at least one carding flat;

pressurized air delivery means connected to said inlet of said nozzle for selectively delivering pressurized air to said inlet of said at least one nozzle;

control means connected to said pressurized air delivery means for selectively causing said pressurized air delivery means to deliver pressurized air to said inlet of said at least one nozzle upon a carding flat being positioned adjacent said outlet of said at least one nozzle for allowing pressurized air to be delivered from said outlet of said nozzle to the carding flat for cleaning debris from the carding flat, and wherein said control means causes said pressurized air delivery means to cease delivery of pressurized air to said inlet of said nozzle upon the carding flat no longer being positioned adjacent said outlet of said nozzle; and said at least one nozzle being configured for directing pressurized air from said outlet thereof to a carding flat in a direction substantially opposite to the direction of travel of the carding flats about said transport path.

9. An apparatus for cleaning debris from a series of moving elongated carding flats of a carding machine, comprising:

a support structure associated with the carding machine adjacent to the carding flats;

a track connected to said support structure;

a carriage carried on said track for movement on said track with respect to said support structure;

at least one nozzle connected to said carriage for movement therewith, said nozzle having an inlet for receiving pressurized air and an outlet for directing the pressurized air towards at least one carding flat;

a fluid-actuated piston/cylinder unit connected to said carriage for selectively moving said carriage upon fluid actuation of said piston/cylinder unit, said carriage being moved by said piston/cylinder unit on said track;

fluid delivery means connected to said piston/cylinder unit for selectively delivering pressurized fluid to said piston/cylinder unit to actuate said piston/cylinder unit;

pressurized air delivery means connected to said at least one nozzle for selectively delivering pressurized air to said inlet of said nozzle;

carding flat sensing means connected to said control means for sensing the position of a carding flat relative to said at least one nozzle; and control means connected to said carding flat sensing means, said pressurized air delivery means and said fluid delivery means; said control means selectively causing said fluid delivery means to deliver pressurized fluid to said piston/cylinder unit for actuation thereof, such that upon said carding flat sensing means sensing a carding flat being positioned adjacent said at least one nozzle, said piston/cylinder unit moves said carriage on said track; said control means selectively causing said pressurized air delivery means to deliver pressurized air to said inlet of said nozzle, thereby allowing pressurized air to be delivered from said outlet of said nozzle to the carding flat for cleaning debris from the carding flat.

10. An apparatus as defined in claim 9, further comprising time delay means connected to said control means for delaying movement of said carriage, such that after said carriage travels on said track a sufficient distance for allowing pressurized air to be directable from said outlet of said nozzle to a substantial portion of the length of a carding flat, said time delay means causes said carriage to pause, and after a predetermined amount of time, to again travel on the track for allowing pressurized air to be directable from said outlet of said nozzle to a substantial portion of the length of the same carding flat.

11. An apparatus as defined in claim 9, wherein said control means causes both said fluid delivery means to deliver pressurized fluid to said piston/cylinder unit and said pressurized air delivery means to deliver pressurized air to said inlet of said nozzle upon sensing that a carding flat is positioned adjacent said outlet of said at least one nozzle; and wherein said control means causes said pressurized air delivery means to cease delivery of pressurized air to said inlet of said nozzle upon the carding flat no longer being positioned adjacent said outlet of said nozzle.

12. An apparatus as defined in claim 9, further comprising an enclosure associated with said carriage and substantially enclosing said track, such that debris is substantially prevented from contacting said track.

13. An apparatus as defined in claim 9, wherein said track and said carriage are configured such that movement of said carriage on said track is substantially rectilinear.

14. An apparatus as defined in claim 9, further comprising carriage reversal means associated with said piston/cylinder unit, wherein upon said carriage traveling on said track a sufficient distance such that pressurized air is directable from said outlet of said nozzle to a substantial portion of the length of a carding flat, said carriage reversal means causes said carriage to reverse direction and to travel on the track in the opposite direction for allowing pressurized air to be directable from said outlet of said nozzle to a substantial portion of the length of the same carding flat.

15. An apparatus as defined in claim 9, wherein said carding flat sensing means includes a proximity sensor associated with said carding machine and connected to said control means for sensing the approach of a carding flat, such that upon sensing the approach of a carding flat, said proximity sensor signals said control means to cause pressurized fluid to be delivered from said fluid delivery means to said piston/cylinder unit and to cause pressurized air to be delivered from said pressurized air delivery means to said inlet of said nozzle.

16. An apparatus as defined in claim 9, wherein said at least one nozzle includes multiple nozzles.

17. An apparatus as defined in claim 9, further comprising carriage sensing means connected to said control means for sensing the position of said carriage on said track.

18. An apparatus as defined in claim 17, wherein said carriage sensing means includes two sensors connected to said piston/cylinder unit for sensing the position of the piston within said piston/cylinder unit.

19. An apparatus as defined in claim 9, wherein said at least one nozzle is configured for directing pressurized air from said outlet thereof to a carding flat in a direction substantially opposite to the direction of travel of the carding flats about said transport path.

20. An apparatus as defined in claim 9, further comprising vacuum means spaced from said at least one nozzle for receiving and transporting away from the carding machine debris removed from a carding flat by said at least one nozzle.

21. A method of non-contact cleaning of debris from a plurality of elongated carding flats of a carding machine, the carding flats being substantially continuously carried about a circuitous transport path, a portion of the transport path being adjacent to a carding cylinder of the carding machine, and another portion of the transport path being spaced from the carding cylinder, such carding flats being of the type having a clothing surface for interacting with fibers on the carding cylinder while on the portion of the transport path adjacent to the carding cylinder, the method comprising:

transporting a carding flat to be cleaned along the transport path to an area for cleaning, such area being spaced away from the carding cylinder;

sensing the location of the carding flat to be cleaned among the plurality of carding flats;

automatically positioning the carding flat to be cleaned adjacent at least one nozzle when the carding flat is in the area for cleaning for directing pressurized air against the clothing surface of the carding flat; and initiating delivery of pressurized air to the nozzle upon the carding flat being positioned adjacent the at least one nozzle such that the pressurized air is delivered from the nozzle to the clothing surface of the carding flat for removal of debris therefrom; and after a predetermined period of time substantially corresponding to the time the carding flat to be cleaned is adjacent the at least one nozzle, automatically shutting off the pressurized air delivery to the nozzle.

22. The method as defined in claim 21, further comprising:

upon initiation of delivery of the pressurized air to the nozzle, oscillating the nozzle substantially along the length of the carding flat to be cleaned for substantially said predetermined amount of time; and after said predetermined period of time, automatically stopping oscillation of nozzle.

* * * * *